US006846275B2

(12) United States Patent
Chen et al.

(10) Patent No.: US 6,846,275 B2
(45) Date of Patent: Jan. 25, 2005

(54) MUSCLE STRENGTHENING METHOD AND APPARATUS

(76) Inventors: Chuan-Show Chen, No. 250, Wenhwa 1 Road, Kweishan Village, Taoyuan Hsien (TW); Tzyy-Yuang Shiang, No. 250, Wenhwa 1 Road, Kweishan Village, Taoyuan Hsien (TW)

( * ) Notice: Subject to any disclaimer, the term of this patent is extended or adjusted under 35 U.S.C. 154(b) by 97 days.

(21) Appl. No.: 09/813,314

(22) Filed: Mar. 21, 2001

(65) Prior Publication Data

US 2003/0013577 A1 Jan. 16, 2003

(51) Int. Cl.[7] ..... A63B 21/00
(52) U.S. Cl. ..... 482/100; 482/4; 482/57
(58) Field of Search ..... 482/4–7, 51, 57, 482/63–65, 92, 100, 903

(56) References Cited

U.S. PATENT DOCUMENTS 5,284,131 A * 2/1994 Gray ..... 601/36
5,421,798 A * 6/1995 Bond et al. ..... 601/23
5,527,249 A * 6/1996 Harris ..... 482/96
5,569,121 A * 10/1996 Sellier ..... 482/5
5,746,684 A * 5/1998 Jordan ..... 482/62

* cited by examiner

*Primary Examiner*—Glenn E. Richman
(74) *Attorney, Agent, or Firm*—Troxell Law Office PLLC

(57) ABSTRACT

A passive repeating plyometric muscle strengthening method and an apparatus for the method, wherein, the amplitude and frequency of up and down moving of the pedal can be adjusted, a trainee is continuously born with a load for exercising in a passive mode to do a plyometric and eccentric contraction muscle training in a short time with a large amount of acting units. Combination of the eccentric contraction and the concentric contraction for muscle training can enhance muscle strength and power, and danger resided in pure muscle training with eccentric contraction can be reduced thereby, a larger effect of muscle training can be obtained to meet the requirement of high acting-speed movements in practical competitions. The method can excite large amount of acting units of a human body in a very short moment. The elastic components in the muscle organization are sufficiently used to make muscle contraction able to generate larger strength and power. The effect of increasing the power is evident.

7 Claims, 5 Drawing Sheets

MUSCLE STRENGTHENING METHOD AND APPARATUS

BACKGROUND OF THE INVENTION

1. Field of the Invention

The present invention is related to a passive repeating plyometric muscle strengthening method and an apparatus for the method, and especially to a method and an apparatus for training a person by continuous bearing of passive exercising load, it is a plyometric and eccentric contraction muscle training in a short time with a large amount of acting units.

2. Description of the Prior Art

Muscle training must progresses gradually; in training muscles of the whole body of a man, we must try to continuously increase the times and load to continuously increase the maximum muscle strength and muscle durability. In a plyometric or rebounding action, there must be a muscle contraction; if an external force (load) is larger than the active resistive capability of the muscle, the muscle is forced to stretch, or when in need by an action, the muscle may actively contract from stretching under some load, these are both called eccentric contraction. And another term "concentric contraction" means that the muscle is shortened when in contraction, thereby limbs will move toward the direction of contraction of the muscle. Almost all the movement actions are completed under interaction of the eccentric contraction and the concentric contraction. When in an eccentric contraction, the muscle is stretched like an elastic body; by elongation of the series elastic components (SEC), strength is generated. The general strength generated can be the sum of the contractile components (CC) and the series elastic components (SEC) (referring to FIG. 1). Such mechanical action increases the induced concentric contraction accompanying with the series elastic components generated. When a larger elongation and contraction action is done, there are a few cross-bridges stretched along therewith in a state of keeping in combination with actin. A faster elongation and eccentric contraction period can store larger mechanic energy source. The combination of the eccentric contraction and the concentric contraction is generally called stretch-shortening cycle. This process will generate larger strength and power output at the last action (concentric contraction) thereof than the pure concentric contraction. Muscle is stretched in advance and then is fast contracted. A scholar Chu (1992) divided the process into the eccentric-phase and the contraction-phase; the former indicates fast stretching of muscle fibers before contraction; while the latter indicates the muscle contraction itself. Chu called the short period between the two phases amortization phase. In addition to this, Verkhoshanski divided the process into the yield phase and the overcoming phase; the former indicates forced stretching of muscle; while the latter indicates the reactive fast muscle contraction. During the eccentric contraction period, load is transformed into the SEC and is stored as an elastic energy source, the concentric contraction thereafter can obtain the elastic energy source stored in the SEC and is used for contraction.

Plyometric muscle training takes advantage of forceful muscle contraction by the elements of elongation, elasticity and contraction of which the elongation is elongated through skeleton, the elasticity is stored to generate force for contraction later for training (Lundin, 1985). The eccentric and concentric contraction style training mode has larger strength and power than the pure concentric contraction style training. The plyometric muscle training is necessary for obtaining good neurotic muscle reflex, stretching reflex, eruptive power and jumping action, especially for obtaining large acting units within a very short time period.

Generally, in using conventional training appliances (such as bar bells or normal muscle training instruments) for training, the appliances are mostly fixed, and exercising is repeated for many times. That is, the appliances themselves are fixed; they are moved or erected by trainees. However, if repeating times by a trainee are few, and speed of action is slow, increasing of strength of muscle must be little. For a normal steady contraction of constant length with slow speed, calling up of acting units is done in a way from slow to fast speed. When in an extremely fast action, the acting units of the slow-twitch muscles will be inhibited, and only the acting units of the fast-twitch muscles are called up. For example, the acting units to act fast with high threshold have the priority to call up when they are in the phase of fast concentric contraction and eccentric or reduced fast muscle action. In the training action modes of the strength of muscles of the lower limbs for the Cheng's passive repeating plyometric muscle strengthening apparatus, the articulates of the lower limbs are moved in the mode of stretching and contracting with high speed. During the action period, the trainees are requested to do their best to step pedals. When it is in the lifting stage of the pedals, the musculus quadriceps femoris, the Achilles tendon and the musculus gastrocnemius are in the full power high-speed eccentric contraction phase. This connects serially with the concentric contraction following immediately to form a stretch-shortening cycle (SSC) of high speed and high strength. When the muscles are stretched to elongate, the fibers of the musculus fusiformis internus in the muscular tissue is simultaneously stretched to elongate to induce reflective muscle contraction. The contractile components (CC) in the muscles and the stored series elastic components (SEC) induced by stretching will generate larger and faster strength. Before muscle contraction, a fast muscle stretching may generate an even larger contraction. While a faster contraction speed can be obtained after muscle stretching (eccentric), having larger and faster concentric strength and power output. And more, the plyometric muscle training increases the threshold of the Golig tendon organ (GTO) and thus increases the threshold of the muscle tendon to increase the load in elongation of muscle. A higher elongation of muscle can resist larger load in elongation to generate stronger elongation reflex.

And more, if a trainee uses a conventional muscle training method, regardless it is for stretching a knee or an elbow, to complete an action, it needs at fastest 0.5~1.0 second, while a violent sporting competition, such as 100 m race, requires only 0.2~0.3 second for stretching a knee. And in an action of skiing down a slope, it needs faster speed (down to several milliseconds for stretching a knee. Thereby, only the passive muscle training with high frequency can render the muscle and neurotic systems to reach the practical conditions approximate to that of a sporting competition.

SUMMARY OF THE INVENTION

The object of the present invention is to provide a passive repeating plyometric muscle strengthening method and an apparatus for training muscles of the whole body of a person gradually, wherein, the repeating speed to move a pedal up and down can be adjusted, weight for training can be adjusted in pursuance of the training target and personal specificity, and the trainee must continuously bear the load for exercising in the passive mode, such passive repeating plyometric exercise with high frequency renders the human body to generate higher resisting capability, hence the human body is forced to elevate its adaptability to force surging of higher level. Thereby, a breaking through training method to stimulate muscles for strengthening is formed, this method combines the plyometric training which uses a large amount of acting units in a short time with the eccentric muscle training, both the trainings are widely adopted presently; such new method is quantitative and highly safe. The quick actions in the training method of the present invention make immediate calling up of the fast-twitch muscular fibers with high thresholds. Stepping action with full high strength renders large amount of the acting muscle group including the slow oxidative muscular fibers with low thresholds and the fast oxidative muscular fibers with high thresholds of exciting to take part in simultaneously. Training for a long period will increase synchronization of exercising units, namely, different exercising units take part in simultaneously; and this especially suits weight lifting and other items requiring quick maximum contraction, synchronization of exercising units is necessary for generating power.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
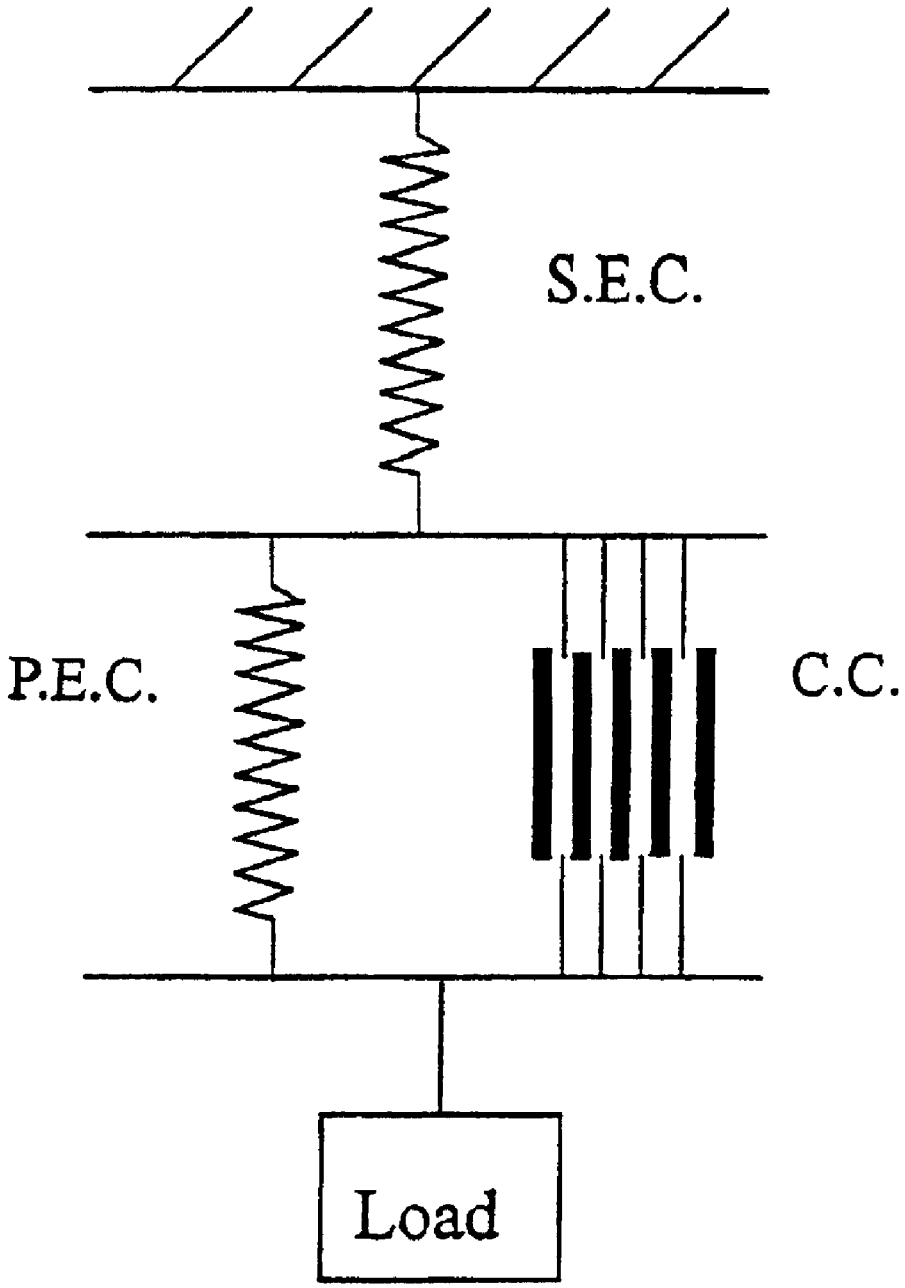
FIG. 1 is a schematic view showing the general strength generated by contracting muscles.
Figure 2:
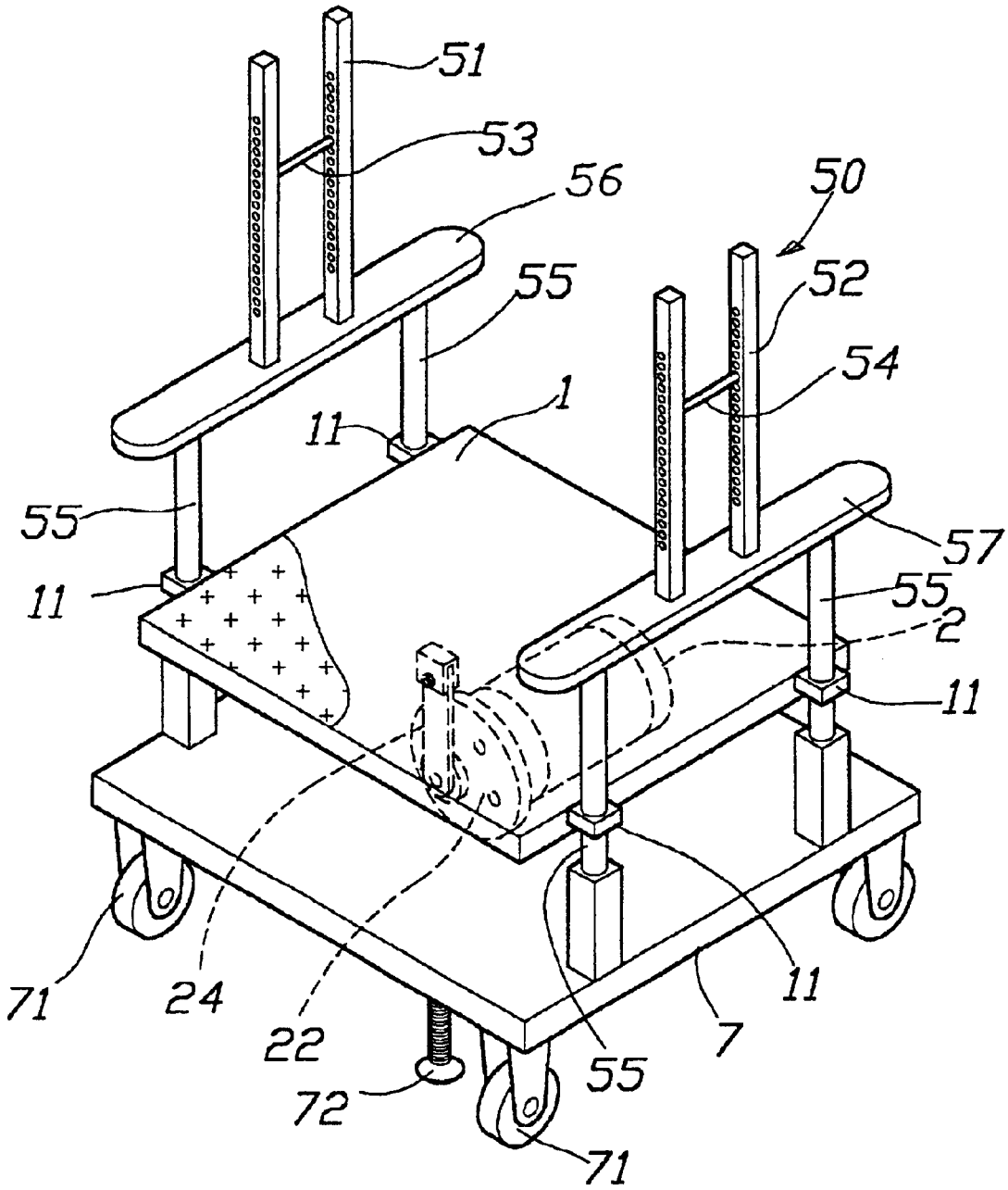
FIG. 2 is a perspective view of an embodiment of a training apparatus of the present invention.
Figure 3:
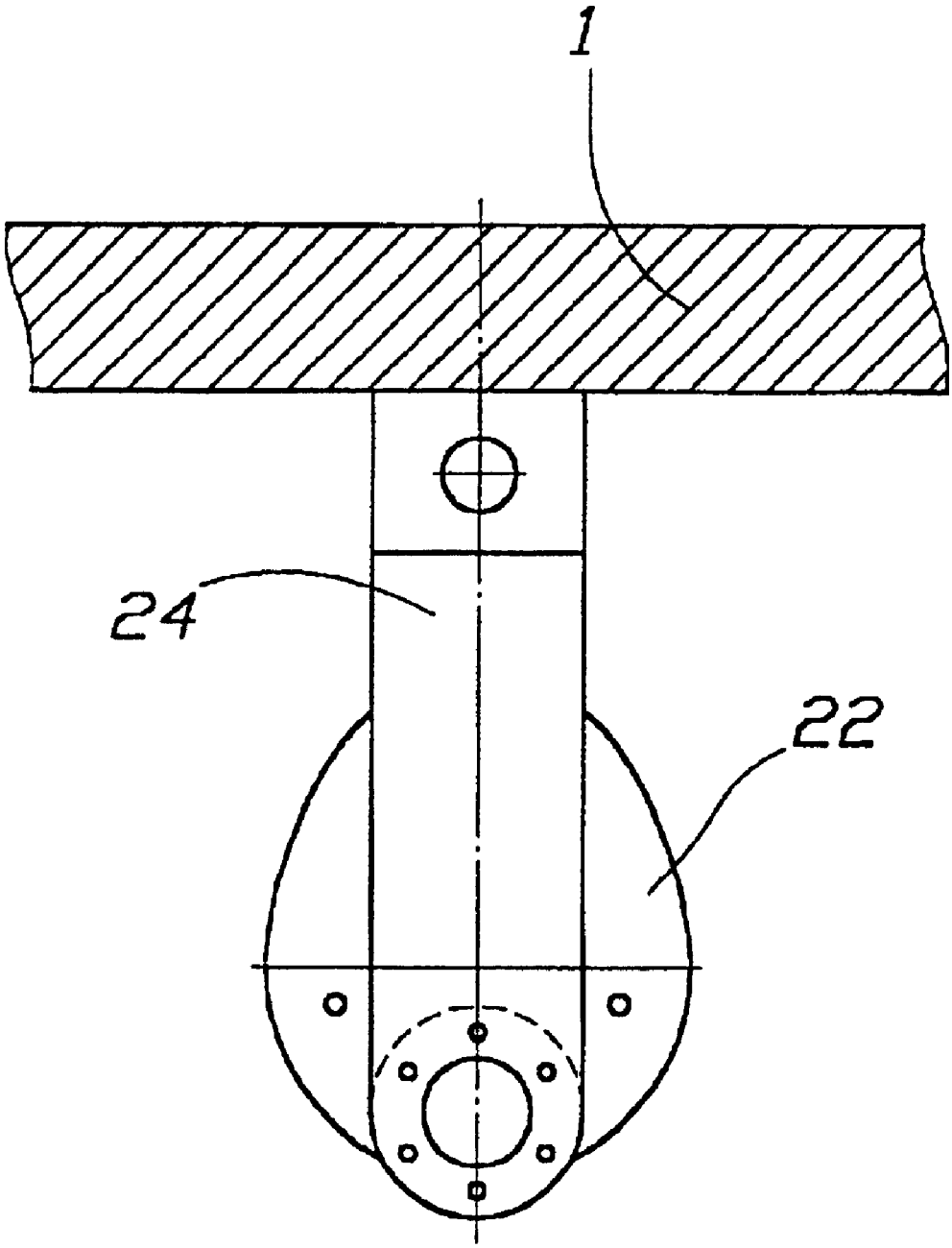
FIG. 3 is a sectional front view showing the state of a driving member in FIG. 2.
Figure 4:
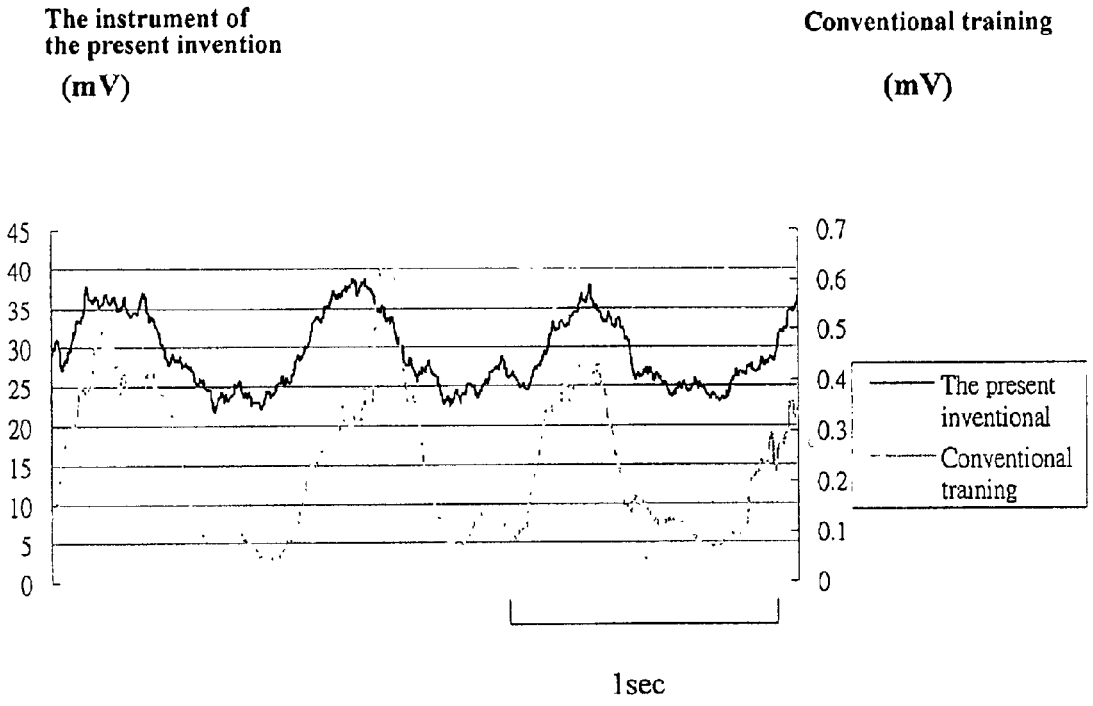
FIG. 4 is a comparative diagram showing the integrated EMG of muscles of rectus femoris in the present invention and the conventional squat movement under the speed of 60 rpm.
Figure 5:
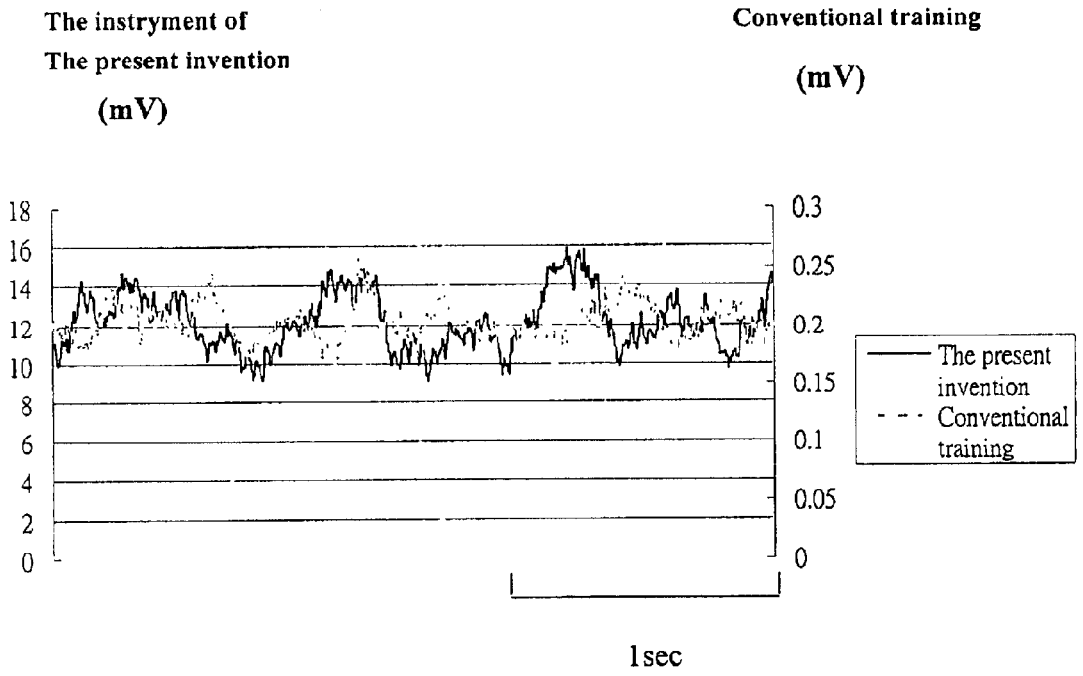
FIG. 5 is a comparative diagram showing the integrated EMG of muscles of biceps femoris in the present invention and the conventional squat movement under the speed of 60 rpm.
Figure 6:
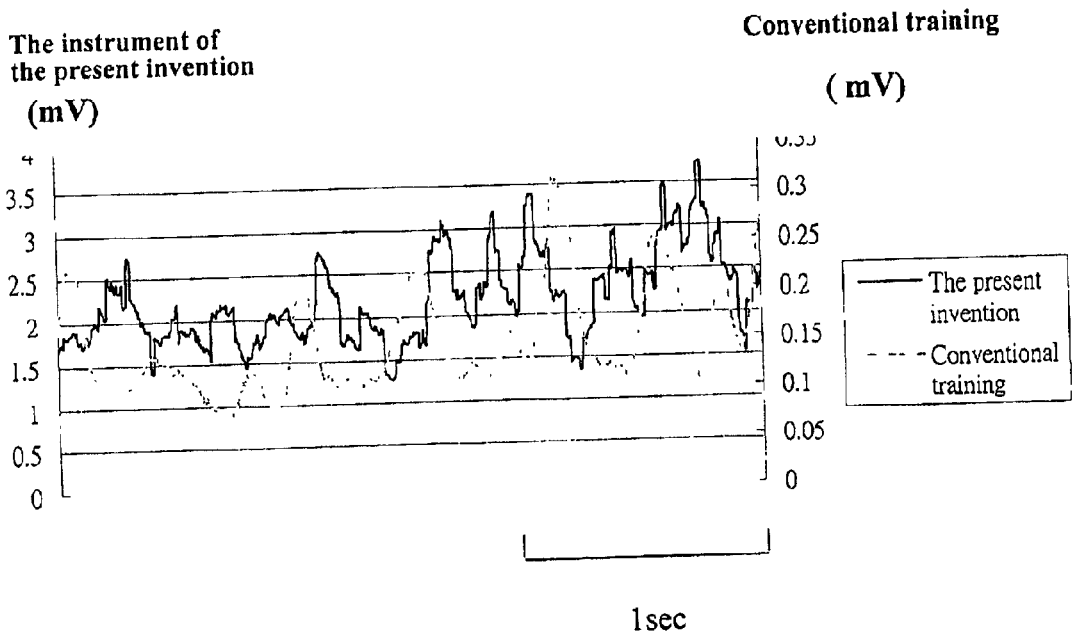
FIG. 6 is a comparative diagram showing the integrated EMG of muscles of tibialis anterior in the present invention and the conventional squat movement under the speed of 60 rpm.
Figure 7:
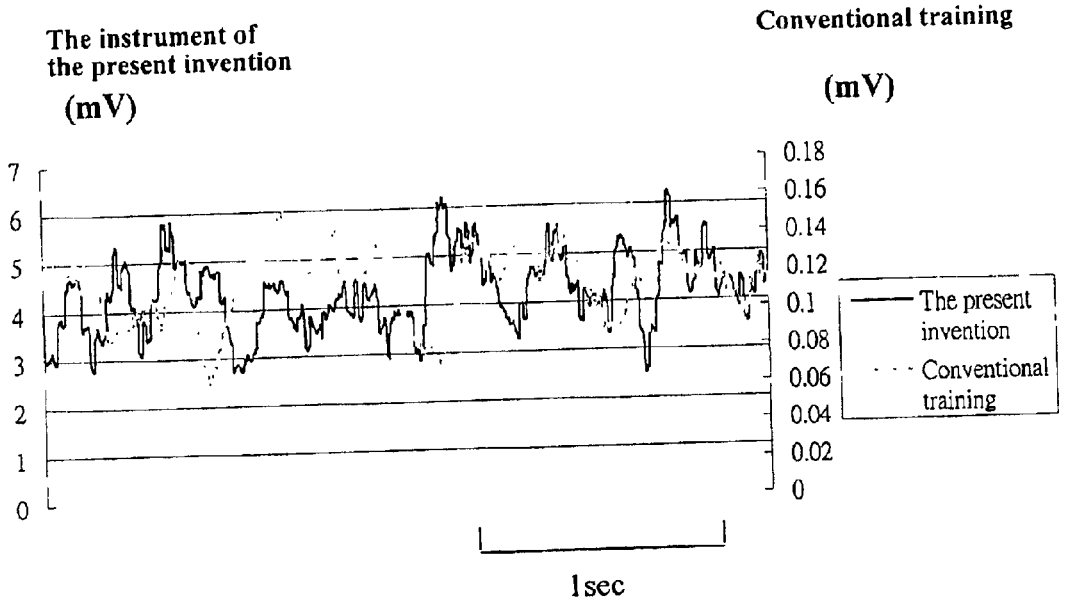
FIG. 7 is a comparative diagram showing the integrated EMG of muscles of gastrocnemius in the present invention and the conventional squat movement under the speed of 60 rpm.

Referring to FIG. 2, 3, a load bearing rack 50 of the present invention is provided thereon with a pedal 1 which can be moved up and down repeatedly with a high frequency under the mode of mechanism transmission.

The training method of the present invention requires that a trainee stands on the pedal 1 which is moved up and down repeatedly. By which, the trainee is continuously born with the load for exercising in the passive mode to do a plyometric and eccentric contraction muscle training in a short time with a large amount of acting units. By simultaneously combining the muscle trainings with eccentric contraction and concentric contraction, muscle strength and power can be enhanced, and danger resided in pure muscle training with eccentric contraction can be reduced, and a larger effect of muscle training can be obtained. Thereby, the training method of the present invention meets the requirement of high acting-speed movements in practical competitions.

In the embodiment of instruments used in the above stated training method, the load bearing rack 50 is comprised of a pair of "H" shaped rack members 51, 52 which are provided respectively with lines of adjustment holes for receiving therein the holding rods 53, 54 of weights (such as barbells), the bottom ends of the rack members 51, 52 are connected to transverse bars 56, 57 on a plurality of upright posts 55 on the surface of a plate seat 7 at the four corners. The plate seat 7 is provided on the bottom surface thereof with rollers 71 at the four corners and with a screw foot 72 for positioning when the rollers 71 arrive at the locations desired. And the abovementioned pedal 1 can be provided with a plurality of movable connecting seats 11 on the upright posts 55.

The pedal 1 can be controlled for moving up and down by means of an electric motor 2 which is provided on the plate seat 7 below the pedal 1, its transmission axle is linked up with an active rotating wheel 22. A follower rod 24 has one end thereof connected to the rotating wheel 22, while the other end thereof is linked up with the pedal 1. In the embodiment shown, the follower rod 24 can be of one of various lengths to connect to different one among a plurality of eccentric positions on the rotating wheel 22 for controlling the stroke of raising/lowering of the pedal 1. In order to assure re-raising of the pedal 1 under a load, the pedal 1 can be mounted with an elastic element in advance, so that the elastic element can be elastically restored from its compression state (due to the pedal 1 being under the load) to assist re-raising of the pedal 1.

The abovementioned electric motor 2 can be set at a rotating rate under 1,000 rpm, and preferably is set between 1.5 rpm to 150 rpm. I.e, speed of repeated up and down moving of the pedal 1 is in the range of 1–1000 times/min., and most preferably is between 30–300 times/min. Rotating rate of the electric motor 2 can be controlled by a variable resistance adjuster connected to the outside.

The above stated equipment is used when a trainee is standing on the surface of the pedal 1 under a load, the pedal 1 can be moved up and down by mechanical driving to obtain the effect of the above stated muscle training. The amplitude of the up and down moving of the pedal 1 can be adjusted in pursuance of the requirement of training, in accompanying with one of various motor rotating rates and an instrument of one of various weights, to practice a training with various stages, and can be adjusted in pursuance of one of different exercising angles of a joint.

By comparison between the conventional muscle training method and the training method of the present invention experimentally, by using a prototype machine presently made to test the effects of the muscle strength and power training of lower limbs, experimental results are obtained and are described below.

1. To Verify the Training Effect of the Present Instrument on Muscle and Power

This part has 14 male persons chosen from the department of Athletics Training & Heath and the Research Institute of Couch of National Physical Education College in Taiwan as the objects of test, they are randomly divided into an experimental group (7 persons) and contrast group (7 persons). The experimental group takes the passive repeating plyometric muscle strengthening apparatus as a training instrument, while the contrast group uses a standing deep-squatting rack for legs to do the conventional training action of squat movement. They are both trained for 6 weeks, twice muscle training for the muscles of "flexor et extensor" of lower limbs each week. The achievements of the maximum muscle strength and vertical forward and rearward jumping are taken as the basis for verifying the training effect.

(1) The content of training of the experimental group:

The speed of moving up and down of the pedal for the muscle training movement of the study is 100 rpm, the range of vertical movement is 100 mm. The action of lower limbs of the persons under test includes the range from the small flexure of the knee joints (when the moving platform is at the lowest position) to the flexure (about 90 degrees) of thighs (when the moving platform is at the highest position). The content of practicing of the training is shown as below:

TABLE 1 the content of practicing of the training

| | |
|---|---|
| The first week | 30% of the maximum muscle strength<br>twice per week<br>three couples each time<br>Repeated sustaining time for each couple is 20 seconds. |
| The second week | 35% of the maximum muscle strength<br>twice per week<br>four couples each time<br>Repeated sustaining time for each couple is 20 seconds. |
| The third week | 40% of the maximum muscle strength<br>twice per week<br>four couples each time<br>Repeated sustaining time for each couple is 20 seconds. |
| The fourth week | 45% of the maximum muscle strength<br>twice per week<br>four couples each time<br>Repeated sustaining time for each couple is 20 seconds. |
| The fifth week | 50% of the maximum muscle strength<br>twice per week<br>four couples each time<br>Repeated sustaining time for each couple is 20 seconds. |
| The fifth week | 55% of the maximum muscle strength<br>twice per week<br>four couples each time<br>Repeated sustaining time for each couple is 20 seconds. |

NOTE:
The time for changing the speed of moving up and down of the pedal from the stationary state to 100 rpm is about 10 seconds, the times listed in the table each includes the accelerating time 10 seconds + the sustaining time 10 seconds.

(2) The content of training of the contrast group:

The group uses a standing-squatting rack for legs to do the conventional equal tension active training. The action in the training starts from a preparing posture wherein the knee joints are stretched straight to the state that the knee joints are bent for 90 degrees and then back to the preparing posture, the entire cycle is called a round of motion (1 RM). Four couples are under training each time, the content of loads in training is shown below in Table 2.

TABLE 2

The schedule of training of the contrast group

| Number of couple | Loads in training | Repeating times |
|---|---|---|
| The first couple | 70% of the maximum muscle strength | 6 RM |
| The second couple | 80% of the maximum muscle strength | 5 RM |
| The third couple | 80% of the maximum muscle strength | 5 RM |
| The fourth couple | 90% of the maximum muscle strength | 3 RM |

NOTE: The time period for training is 6 weeks, if 4 RM can be completed in the fourth couple, the loads in training next time are increased (at least 5 kg increment each time).

2. Comparison of Extent of Activities with Electromyogram

From comparison by means of electromyograms, 3 persons are chosen from the 7 persons under the training of the experimental group, the extent of activities on the electromyograms of the lower limbs moved in the mode of stretching and contracting, the muscles of flexor of the lower limbs and the muscles of extensor of lower limbs are compared between using the passive repeating plyometric muscle strengthening apparatus and using the standing-squatting rack for the conventional equal tension active training.

Method and Steps of Practicing:

(1) The instrument used is connected to do the tests of functions.

(2) According to the distances of height of the lowest and the highest positions of the pedal from the barbell to mark the up and down range of the conventional squat movement in the training squat rack with sticking cloths when each of the persons under test is trained with the passive repeating plyometric muscle strengthening apparatus.

(3) The persons under test do the practice of squat movement according to the range of activities marked for the training of squat movement with an empty barbell following the speed (60 rpm) of the pedal of the instrument moving up and down, so that the frequencies and extent of their actions can be correct and stable.

(4) The areas that the muscles stick to the electromuscular pre-amplifier are scrubbed with cotton dipped with alcohol for testing, the grease and unnecessary electric resistant material on the surfaces of skin are removed; if the sticking areas of the pre-amplifier have thereon hairs, they shall be cleaned out by scrapping. Then the sticking cloths are used to stick the electromuscular pre-amplifier to the area for testing muscles. The muscles tested are the muscles of rectus femoris on the customarily used sides, the caput longum musculus biceps femoris, the musculus tibialis anterior and the caput laterale musculus gastrocnemius.

(5) The electromyogram (EMG) signals of the lower limbs are recorded; the load is 60 kg. The sequence of the test is: 1, the conventional squat movement (60 rpm); 2, the passive repeating plyometric muscle strengthening apparatus (60 rpm).

(6) Processing of the data from the electromyograms:

1. The sample of the training is set with 500 Hz, the time of recording is 6 seconds.
2. The original electromuscular signals of each person under test is quantified, and is transformed into integrated electromyograms (IEMG) by means of an acknowledged software, and the data of the electromuscular signals in 2–5 seconds in the process of action is intercepted and stored.

3. The integrated electromuscular data of the persons under test are used to draw the electromyograms of various muscles under different situations.
4. The integrated electromuscular signal data in 2–5 seconds in the process of action of different exercising modes of 3 persons under test are summed up to obtain the average value of the extent of activities on the electromyograms, and are compared.

Analysis and Processing of the Data:

All the personal data and test achievements of the persons under test are expressed in average values and standard difference. In statistics and processing, the statistic kit software of SPSS for Windows is used for processing and analysis of data, the level as being obvious in the statistic test is set as: P<0.05.

1. In the test with mutual dependent samples "t", the test results of the muscle strength and power and the difference between the average values of the variants respectively of the stages before and after the training of the experimental group and the contrast group are compared.
2. In the test with independent samples "t", the test results of the muscle strength and power and the difference between the average values of the variants respectively of the experimental group and the contrast group are compared. Comparison of the maximum muscle strengths between the experimental group and the contrast group is to test after changing over the achievements gotten before and after the training by calculation into percentages of extent of progressing.
3. And make comparison with the average values of the integrated electromyogram (IEMG) signals on the electromyograms of the lower limbs moved in the mode of stretching and contracting, the muscles of flexor of the lower limbs and the muscles of extensor of lower limbs between using of the passive repeating plyometric muscle strengthening apparatus and using of the conventional equal tension active training.

Results:

1. The Training Effect of the Present Instrument on Muscle and Power

After verifying the effects in increasing the muscle strength and the power after training with the passive repeating plyometric muscle strengthening apparatus as the training tool, the results obtained in the test with samples "t" before and after the training are compared as below:

TABLE 3 the examination table of influence on the samples "t" by the muscle strength and the power with the instrument (N = 7)

| | Test before training | | Test after training | | |
|---|---|---|---|---|---|
| | M | (SD) | M | (SD) | t value |
| Muscle strength (kg W) | 165.89 | (19.02) | 208.64 | (26.05) | −7.795** |
| Power (cm) | 59.42 | (10.15) | 65.28 | (8.47) | −6.947** |

**P < .01

It can be seen from the above table 3 that, after two day training each week in the 6 week training with the passive repeating plyometric muscle strengthening apparatus, the muscle strength and the power of the lower limbs are obviously elevated. For the muscle strength, t=165.89 (P<0.01); while for the power, t=59.42 (P<0.01).

After verifying the effects in increasing the muscle strength and power after training with the passive repeating plyometric muscle strengthening apparatus and the conventional equal tension squat movement active training, the results obtained in the test with independent samples "t" are compared are as below:

TABLE 4 the examination table of influence on the muscle strength and the power of the instrument and the conventional equal tension squat movement active training (N = 14)

| | The experimental group | | The contrast group | | |
|---|---|---|---|---|---|
| | M | (SD) | M | (SD) | t value |
| Muscle strength (%) | 25.88 | (9.24) | 18.39 | (3.95) | 1.838 |
| Power (cm) | 5.85 | (2.23) | 3.50 | (1.00) | 2.516* |

*P < 0.5

It can be seen from the above table 4 that, after two day training each week in the 6 week training with the passive repeating plyometric muscle strengthening apparatus and the conventional equal tension squat movement active training, the training effect of muscle strength and the power of the lower limbs are compared. Both the two methods have obvious effects on increasing the maximum muscle strengths. However, there is no obvious difference between the two methods in that t=1.838 (P>0.5). While in the effect of increasing the power, the effect of the passive repeating plyometric muscle strengthening apparatus is evidently superior to that of the conventional equal tension squat movement active training of which t=2.516 (P<0.5).

2. Comparison on the Extent of Activities in Electromyograms for the Training of Passive Repeating Plyometric Muscle Strengthening Apparatus and the Conventional Active Equal Tension Squat Movement Training The integrated electromuscular signals of lower limb muscle clusters generated in the passive repeating plyometric muscle strengthening apparatus and the conventional equal tension squat movement active training are separately collected under identical action speed of 60 rpm.

TABLE 5 the table of comparison of the average values of the integrated electromuscular signals of lower limb muscle clusters on the instrument and the conventional equal tension squat movement active training Unit: mV (N = 3)

| | musculus rectus femoris | | musculus biceps femoris | | musculus tibialis anterior | | musculus gastrocnemius | |
|---|---|---|---|---|---|---|---|---|
| | M | (SD) | M | (SD) | M | (SD) | M | (SD) |
| conventional: | 0.32 | (0.17) | 0.24 | (0.05) | 0.21 | (0.12) | 0.22 | (0.09) |
| the instrument: | 22.04 | (8.16) | 11.80 | (3.19) | 5.30 | (2.32) | 4.36 | (0.59) |

It can be seen from the above table 5 that, when stretching and contracting of the lower limbs are done with the passive repeating plyometric muscle strengthening apparatus under the speed of 60 rpm, the values of the integrated electromuscular signals of the lower limb muscle clusters detected are evidently higher than the values of the electromuscular signals of the lower limb muscle clusters in the conventional equal tension squat movement active training. The diagrams for comparison of the integrated electromuscular signals of these muscles are depicted in FIGS. 4, 5, 6 and 7. In the drawings, the main coordinate (the left one) indicates the values of the integrated electromuscular signals of the lower limb muscle clusters in doing repeated stretching and contracting of the lower limbs with the passive repeating plyometric muscle strengthening apparatus; while the subsidiary coordinate (the right one) indicates the values of the integrated electromuscular signals of the lower limb muscle clusters in doing the conventional equal tension squat movement active training.

Conclusion:

According to the results of study, the passive repeating plyometric muscle strengthening apparatus can be used for the exercising items to strengthen the muscle strength and the power, especially for the exercising items requiring fast calling up the fast-twitch muscular fibers, for example, weight lifting, long jump and short-distance racing etc. In the first stage of training, the conventional equal tension training can be used to strengthen the basic muscle strength in cooperation with the instrument of the present invention to do the specific power training.

The training method and equipment of the present invention can have the following advantages:

1. The training method can excite large amount of acting units of a human body in a very short moment.
2. The elastic components in the muscle organization are sufficiently used to make muscle contraction able to generate larger muscle strength and power by participation of the elastic components.
3. The effect of increasing the power is evident.

The embodiments of the present invention stated above are only for illustrating the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

What is claimed is:

1. A passive repeating plyometric muscle strengthening method which comprises the following steps:

positioning a trainee on a pedal;

adjustably moving the pedal up and down repeatedly under a load for exercising by slipping the pedal over a plurality of upright posts on a surface of a plate seat, and moving the pedal up and down by an electric motor; and burdening the trainee with a continuous load to perform plyometric and eccentric contraction muscle training in a short time with a large mount of acting units.

2. A passive repeating plyometric muscle strengthening method according to claim 1, wherein the step of moving the pedal up and down is set at a speed between 1 and 1000 times per minute.

3. A passive repeating plyometric muscle strengthening method according to claim 1, wherein the burdening step uses a load bearing rack provided on the upright posts.

4. A passive repeating plyometric muscle strengthening method according to claim 3, wherein the step of moving is carried out by setting a rotating rate of the motor between 1 rpm and 1000 rpm.

5. A passive repeating plyometric muscle strengthening method according to claim 3, wherein the step of moving is carried out by controlling the rotating rate of the motor by a variable resistance adjuster.

6. A passive repeating plyometric muscle strengthening method according to claim 1, wherein the step of adjustably moving the pedal utilizes the electric motor to drive a rotating wheel, a follower rod has a first end linked with the pedal and a second end linked eccentrically to the rotating wheel.

7. A passive repeating plyometric muscle strengthening method according to claim 6, wherein the step of adjustably moving the pedal includes adjusting an amplitude of the up and down m ion of the pedal.

* * * * *